US005116248A

United States Patent [19]

Hiers et al.

[11] Patent Number: 5,116,248

[45] Date of Patent: May 26, 1992

[54] POWER PLUG FOR RADAR WARNING DETECTOR

[75] Inventors: John D. Hiers, Connersville, Ind.; Michael D. Valentine, Cincinnati, Ohio

[73] Assignee: Valentine Research, Inc., Cincinnati, Ohio

[21] Appl. No.: 652,613

[22] Filed: Feb. 8, 1991

[51] Int. Cl.[5] ..... H01R 17/18

[52] U.S. Cl. ..... 439/669; 439/586

[58] Field of Search ..... 439/668, 669, 675, 638, 439/34, 586, 587, 271, 272, 273; 219/264-270

[56] References Cited

U.S. PATENT DOCUMENTS

| | | | |
|---|---|---|---|
| 2,274,068 | 2/1947 | Johnson | 219/264 |
| 2,489,037 | 11/1949 | Kailer | 439/668 |
| 2,637,799 | 5/1953 | Wood | 219/269 |
| 2,648,758 | 8/1953 | Kroll et al. | 219/264 |
| 4,622,454 | 11/1986 | Castille | 219/267 |
| 4,988,315 | 1/1991 | Wharton | 439/668 |

*Primary Examiner*—David L. Pirlot

*Attorney, Agent, or Firm*—Killworth, Gottman, Hagan & Schaeff

[57] ABSTRACT

A power plug is provided for electrically connecting a receiver of a radar warning detector with an electrical system of a motor vehicle. The power plug comprises a plastic housing having a forward tubular end which is insertable within a lighter socket of the vehicle. Metallic spring arms are mounted within the forward tubular end of the power plug and extend outwardly therefrom to electrically connect the receiver with the vehicle's electrical system. One or more resilient power plug pads are mounted to the forward tubular end of the power plug and serve to frictionally engage the lighter socket to resist movement of the power plug within the socket, thereby ensuring that the power plug remains positioned within the lighter socket even during prolonged periods of operation of the radar warning detector.

15 Claims, 1 Drawing Sheet

POWER PLUG FOR RADAR WARNING DETECTOR

BACKGROUND OF THE INVENTION

The present invention relates generally to a power plug receivable within a lighter socket of a motor vehicle for connecting an electrically powered device to the electrical system of the motor vehicle, and more particularly, to such a power plug which includes at least one securing pad mounted thereon for frictionally engaging the lighter socket to resist movement of the power plug within the socket. The present invention is particularly applicable for powering radar detectors and accordingly will be described with reference to this application.

Radar warning detectors are known in the prior art. Such detectors comprise a police radar warning receiver which is mountable in a vehicle, such as a car, truck, boat, or the like, which travels in areas subject to speed-monitoring radar surveillance by police. The warning receiver functions to detect the presence of police radar and provides the driver or user with an audible and/or visual indication that his speed is being checked by radar. Typically, the receiver comprises operating circuitry and an antenna, which are mounted within a box-shaped housing positionable on the dashboard of a vehicle. The front of the housing faces the driver and has indicators and control knobs. Extending from the housing is a power cord terminating in a power plug which is appropriately configured to be received within the vehicle's lighter socket. The power plug connects electrical energy from the vehicle's electrical system to the receiver via the power cord.

Prior art power plugs comprise a plastic housing having a forward tubular end which is shaped to be slidably received within a vehicle's lighter socket. Typically positioned opposite the tubular end of the housing is a gripping end sized to be gripped between the user's fingers and thumb for insertion and removal of the plug from the lighter socket. Commonly mounted in the distal end of the forward tubular end of the housing is a contact which provides an electrical connection with the vehicle's electrical system (normally, the positive supply line or the positive terminal of the vehicle battery). Also mounted in the forward tubular end of the housing and extending therefrom are metallic spring arms which provide an electrical connection with the vehicle's electrical system (normally, the vehicle ground). The spring arms further serve to releasably retain the tubular end of the housing within the lighter socket.

It has been found that these prior art power plugs have a tendency to move out of a vehicle's lighter socket due to vibrations generated by the vehicle. Accordingly, there is a need for an improved power plug which can be readily inserted into and removed from the lighter socket of a motor vehicle yet is reliably retained within the lighter socket.

SUMMARY OF THE INVENTION

This need is met by the power plug of the present invention which includes plug securing means for reliably retaining the plug in a lighter socket for even extended periods of time in spite of substantial vibrations within the socket. The power plug includes a plastic housing having a forward tubular end which is insertable within a lighter socket of a vehicle. One or more metallic spring arms are mounted within the forward tubular end of the power plug and extend therefrom to electrically connect the receiver of a radar warning detector with the vehicle's electrical system much as in prior art arrangements. However, in accordance with the present invention, one or more resilient power plug pads are mounted to the forward tubular end of the power plug to frictionally engage the lighter socket and thereby resist movement of the power plug within the socket. Thus, the resilient pads ensure that the power plug remains positioned within the lighter socket even during prolonged periods of time yet permit the plug to be readily inserted into and removed from the socket.

In accordance with a first aspect of the present invention, a power plug adapted to be received within a lighter socket of a motor vehicle is provided for electrically connecting a device, such as a radar warning receiver, with an electrical system of the motor vehicle. The power plug comprises a housing having a forward tubular end sized to be slidingly received within the lighter socket and a rearward handle end sized to be conveniently gripped between a thumb and fingers of a human hand. A first contact is mounted in the outermost end of the forward tubular end of the housing and extends from the outermost end for electrically contacting the electrical system when the forward tubular end is inserted within the lighter socket. At least one outwardly bowed metallic spring arm is secured within the housing and projects outside the forward tubular end of the housing for electrically contacting the electrical system when the forward tubular end is inserted within the lighter socket. Power plug securing means is mounted to the forward tubular end of the housing for frictionally engaging the socket to resist movement of the power plug within the socket.

The power plug securing means may comprise at least one power plug securing pad mounted to the forward tubular end of the housing. Each power plug securing pad preferably comprises a main body portion and two securing tabs extending from opposite ends thereof. The tabs engage within a corresponding opening located in the forward tubular end of the housing to mount the pad to the housing. Preferably, each power plug securing pad is made from a polymeric material, such as synthetic rubber.

The power plug may include an outwardly bowed metallic spring arm and two securing pads, with the spring arm and the pads being substantially equally spaced around the forward tubular end of the housing. Alternatively, the power plug may include a pair of outwardly bowed metallic spring arms diametrically opposed to one another and a pair of power plug securing pads diametrically opposed to one another, with the spring arms and the pads being substantially equally spaced around the forward tubular end of the housing.

The forward tubular end of the housing preferably comprises a cylindrical extension terminated at its distal end by a concentric flange for being engaged by a spring within the lighter socket for further securing the power plug within the lighter socket once inserted therein.

In accordance with a second aspect of the present invention, a power plug adapted to be received within a lighter socket of a motor vehicle is provided for electrically connecting a device, such as a radar warning receiver, with an electrical system of the motor vehicle. The power plug comprises a housing having a forward tubular end sized to be slidingly received within the lighter socket and a rearward handle end sized to be conveniently gripped between a thumb and fingers of a human hand. A first contact is mounted in the outermost end of the forward tubular end of the housing and extends from the outermost end for electrically contacting the electrical system when the forward tubular end is located within the lighter socket. At least one outwardly bowed metallic spring arm is secured within the housing and projects outside the forward tubular end of the housing for contacting the lighter socket. The spring arm serves to electrically connect to the electrical system and frictionally engage the socket to resist movement of the power plug within the socket when the forward tubular end is inserted within the lighter socket. At least one power plug securing pad is mounted to the forward tubular end of the housing for frictionally engaging the socket to further resist movement of the power plug within the socket.

The power plug securing pad preferably is made from a resilient material which results in a high coefficient of static friction between the outer surface of the resilient material and the inner surface of the lighter socket when the forward tubular end is located within the lighter socket. The resilient material may comprise a polymeric material, such as synthetic rubber.

Accordingly, it is an object of the present invention to provide an improved power plug which is capable of remaining inserted within a vehicle's lighter socket in spite of substantial vibrations and for long periods of operation. It is a further object of the present invention to provide a power plug insertable within a lighter socket having one or more resilient securing pads mounted thereon for frictionally engaging the lighter socket to resist movement of the power plug within the socket. This and other objects and advantages of the invention will be apparent from the following description, the accompanying drawings and the appended claims.

DETAILED DESCRIPTION OF THE INVENTION

Figure 1:
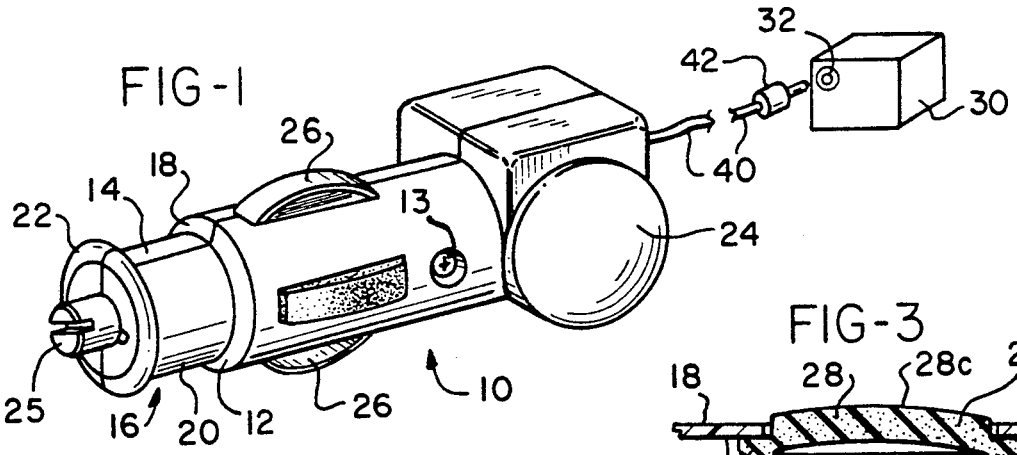
FIG. 1 is a perspective view of the power plug of the present invention connected to a radar warning receiver via a power cord.

The power plug of the present invention, generally designated by the reference numeral 10, is shown in FIG. 1 electrically connected to a radar warning receiver 30 via a power cord 40. The power cord 40 includes a plug 42 adapted to be received in a jack 32 in the housing of the receiver 30. Typical of the receiver 30 is the radar warning receiver disclosed in U.S. Pat. No. 4,613,989, entitled "Police Radar Warning Receiver," the disclosure of which is hereby incorporated by reference.

Figure 7:
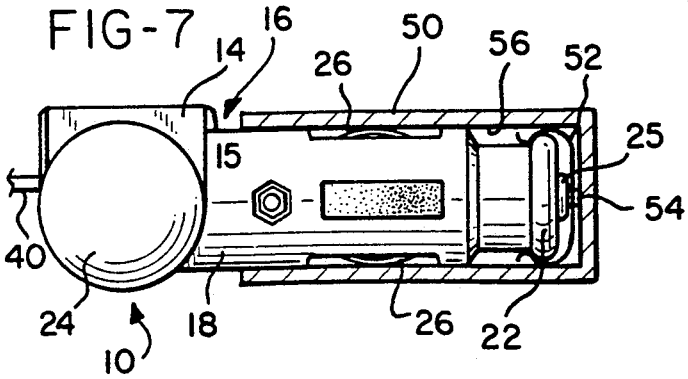
FIG. 7 illustrates the power plug of FIG. 1 inserted within a lighter socket, which is shown in cross-section.

The power plug 10 is comprised of plastic housing sections 12 and 14 held together by a screw 13 and a nut 15. The housing sections 12 and 14 combine to form a housing unit 16 which includes a forward tubular end 18 sized to be slidingly received within a motor vehicle lighter socket 50, as shown in FIG. 7. The forward tubular end 18 includes a cylindrical extension 20 (also referred to herein as the outermost end of the forward tubular end 18), which is terminated at its distal end by a concentric flange 22. A spring 52 is provided within the lighter socket 50 to engage the concentric flange 22 to assist in securing the power plug 10 in the socket 50 once the plug 10 is inserted therein. Normally, the spring, forming a part of the motor vehicle lighter socket 50, is made from a bi-metallic material for operation with the vehicle lighter. Positioned opposite the tubular end 18 of the housing unit 16 is a gripping end 24 sized to be easily gripped between the user's fingers and thumb for insertion and removal of the plug 10 from the lighter socket 50.

A spring-biased, metallic contact post 25 is mounted in the outermost end 20 of the forward tubular end 18 of the housing unit 16. The contact post 25 engages a center contact 54 positioned within the lighter socket 50 to electrically connect the power plug 10 with the vehicle's electrical system (typically, the positive supply line or the positive terminal of the vehicle battery (not shown)).

Figure 2:
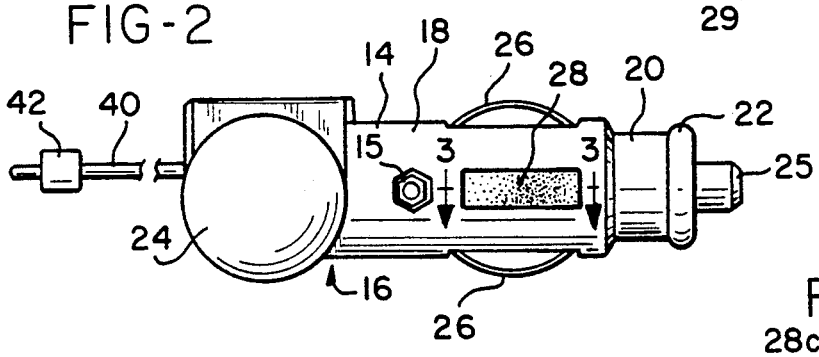
FIG. 2 is a side elevational view of the power plug of FIG. 1.

A pair of outwardly bowed spring arms 26 are secured within the forward tubular end 18 of the housing 16 and project outwardly therefrom. Preferably, the spring arms 26 are diametrically opposed to one another, as shown in FIGS. 1 and 2 The spring arms 26 are made from a metallic material and serve to further electrically connect the power plug 10 with the vehicle's electrical system (typically, the vehicle ground). The spring arms 26 additionally serve to frictionally engage with the lighter socket 50 to assist in retaining the forward tubular end 18 of the power plug 10 within the lighter socket 50.

Figure 3:
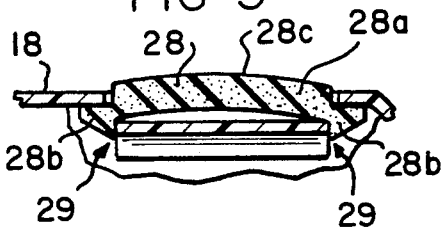
FIG. 3 is a sectional view along section line 3—3 in FIG. 2.
Figure 5:
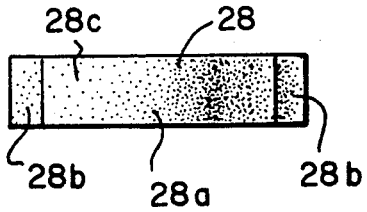
FIG. 5 is a top plan view of a securing pad mounted to the power plug of the present invention.
Figure 4:
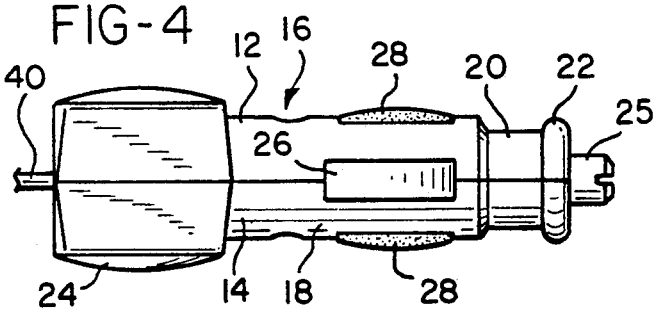
FIG. 4 is a top plan view of the power plug of FIG. 1.
Figure 6:
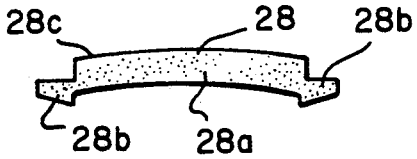
FIG. 6 is a side elevational view of the securing pad shown in FIG. 5.

In order to ensure that the forward tubular end 18 of the housing unit 16 remains engaged within the lighter socket 50, one or more power plug securing pads 28 are mounted to the forward tubular end 18 of the power plug 10. The securing pads 28 act to frictionally engage the inner surface 56 of the lighter socket 50 to further resist movement of the plug 10 therein. Each securing pad 28 includes a main body portion **28*a* and two securing tabs 28*b* positioned at opposite ends of the main body portion 28*a*, as shown in FIGS. 3, 5 and 6. Each securing tab 28*b* is engageable within a corresponding opening 29 located in the forward tubular end 18 of the power plug 10 so as to mount the pad 28 to the plug 10. Preferably, the securing pads 28 are made from a resilient material which results in a high coefficient of static friction between the outer surface 28*c* of each pad 28 and the inner surface 56 of the lighter socket 50 when the plug 10 is inserted within the socket 50**. The resilient material preferably comprises a polymeric material, such as synthetic rubber.

With the foregoing, a power plug is provided which includes one or more resilient securing pads mounted thereto which serve to frictionally engage with the inner surface of a lighter socket to ensure that the power plug remains positioned within the lighter socket in spite of substantial vibrations and for prolonged periods of operation.

Having described the invention in detail and by reference to preferred embodiments thereof, it will be apparent that modifications and variations are possible without departing from the scope of the invention defined in the appended claims.

What is claimed is:

1. A power plug adapted to be received within a lighter socket of a motor vehicle for electrically connecting a device, such as a radar warning receiver, with an electrical system of the motor vehicle, said power plug comprising:

a housing having a forward tubular end sized to be slidingly received within said lighter socket and a rearward handle end sized to be conveniently gripped between a thumb and fingers of a human hand;

a first contact mounted in the outermost end of said forward tubular end of said housing and extending from said outermost end for electrically contacting said electrical system when said forward tubular end is inserted within said lighter socket;

at least one outwardly bowed spring arm secured within said housing and projecting outside said forward tubular end of said housing for electrically contacting said electrical system when said forward tubular end is inserted within said lighter socket; and resilient polymeric power plug securing means mounted to said forward tubular end of said housing for frictionally engaging within said socket to resist movement of said power plug within said socket.

2. A power plug adapted to be received within a lighter socket of a motor vehicle as claimed in claim 1, wherein said forward tubular end of said housing comprises a cylindrical extension terminated at its distal end by a concentric flange for being engaged by a spring within said lighter socket for further securing said power plug within said lighter socket once inserted therein.

3. A power plug adapted to be received within a lighter socket of a motor vehicle as claimed in claim 1, wherein said power plug securing means is made from a polymeric material comprising synthetic rubber.

4. A power plug adapted to e received within a lighter socket of a motor vehicle as claimed in claim 1, wherein said power plug securing means is made from a resilient material which results in a high coefficient of static friction between its outer surface and the inner surface of said lighter socket when said forward tubular end is located within said lighter socket.

5. A power plug adapted to be received within a lighter socket of a motor vehicle as claimed in claim 1, wherein said power plug securing means comprises at least one power plug securing pad mounted to said forward tubular end of said housing.

6. A power plug adapted to be received within a lighter socket of a motor vehicle as claimed in claim 5 comprising one outwardly bowed spring arm and two securing pads, said spring arm and said pads being substantially equally spaced around said forward tubular end of said housing.

7. A power plug adapted to be received within a lighter socket of a motor vehicle for electrically connecting a device, such as a radar warning receiver, with an electrical system of the motor vehicle, said power plug comprising:

a housing having a forward tubular end sized to be slidingly received within said lighter socket and a rearward handle end sized to be conveniently gripped between a thumb and fingers of a human hand;

a first contact mounted in the outermost end of said forward tubular end of said housing and extending from said outermost end for electrically contacting said electrical system when said forward tubular end is located within said lighter socket;

at least one outwardly bowed spring arm secured within said housing and projecting outside said forward tubular end of said housing for contacting said lighter socket, said at least one spring arm electrically contacting said electrical system and frictionally engaging said socket to resist movement of said power plug within said socket when said forward tubular end is inserted within said lighter socket; and at least one polymeric power plug securing pad mounted to said forward tubular end of said housing, said securing pad frictionally engaging within said socket to further resist movement of said power plug within said socket.

8. A power plug adapted to be received within a lighter socket of a motor vehicle as claimed in claim 7 comprising one outwardly bowed spring arm and two securing pads, said spring arm and said pads being substantially equally spaced around said forward tubular end of said housing.

9. A power plug adapted to be received within a lighter socket of a motor vehicle as claimed in claim 7 comprising a pair of outwardly bowed spring arms diametrically opposed to one another and a pair of power plug securing pads diametrically opposed to one another, said spring arms and said pads being substantially equally spaced around said forward tubular end of said housing.

10. A power plug adapted to be received within a lighter socket of a motor vehicle as claimed in claim 7 wherein said forward tubular end of said housing comprises a cylindrical extension terminated at its distal end by a concentric flange for being engaged by a spring within said lighter socket for further securing said power plug within said lighter socket once inserted therein.

11. A power plug adapted to be received within a lighter socket of a motor vehicle as claimed in claim 7 wherein said at least one power plug securing pad is made from a polymeric material comprising synthetic rubber.

12. A power plug adapted to be received within a lighter socket of a motor vehicle as claimed in claim 7 wherein said at least one power plug securing pad is made from a resilient material which results in a high coefficient of static friction between the outer surface of said resilient material and the inner surface of said lighter socket when said forward tubular end is located within said lighter socket.

13. A power plug adapted to be received within a lighter socket of a motor vehicle as claimed in claim 7, wherein said power plug securing pad comprises a main body portion and two securing tabs extending from opposite ends thereof, each of said tabs engaging within a corresponding opening located in said forward tubular end of said housing to mount said pad to said housing.

14. A power plug adapted to be received within a lighter socket of a motor vehicle for electrically connecting a device, such as a radar warning receiver, with an electrical system of the motor vehicle, said power plug comprising:

a housing having a forward tubular end sized to be slidingly received within said lighter socket and a rearward handle end sized to be conveniently gripped between a thumb and fingers of a human hand;

a first contact mounted in the outermost end of said forward tubular end of said housing and extending from said outermost end for electrically contacting said electrical system when said forward tubular end is inserted within said lighter socket;

a pair of outwardly bowed spring arms diametrically opposed to one another and secured within said housing and projecting outside said forward tubular end of said housing for electrically contacting said electrical system when said forward tubular end is inserted within said lighter socket; and power plug securing means comprising a pair of power plug securing pads diametrically opposed to one another and mounted to said forward tubular end of said housing for frictionally engaging said socket to resist movement of said power plug within said socket, said spring arms and said pads being substantially equally spaced around said forward tubular end of said housing.

15. A power plug adapted to be received within a lighter socket of a motor vehicle for electrically connecting a device, such as a radar warning receiver, with an electrical system of the motor vehicle, said power plug comprising:

a housing having a forward tubular end sized to be slidingly received within said lighter socket and a rearward handle end sized to be conveniently gripped between a thumb and fingers of a human hand;

a first contact mounted in the outermost end of said forward tubular end of said housing and extending from said outermost end for electrically contacting said electrical system when said forward tubular end is inserted within said lighter socket;

at least one outwardly bowed spring arm secured within said housing and projecting outside said forward tubular end of said housing for electrically contacting said electrical system when said forward tubular end is inserted within said lighter socket; and power plug securing means mounted to said forward tubular end of said housing for frictionally engaging said socket to resist movement of said power plug within said socket, said power plug securing means comprising at least one power plug securing pad having a main body portion and two securing tabs extending from opposite ends thereof, each of said tabs engaging within a corresponding opening located in said forward tubular end of said housing to mount said pad to said housing.

* * * * *

UNITED STATES PATENT AND TRADEMARK OFFICE

CERTIFICATE OF CORRECTION

PATENT NO. : 5,116,248

DATED : May 26, 1992

INVENTOR(S) : Hiers et al

It is certified that error appears in the above-identified patent and that said Letters Patent is hereby corrected as shown below:

Col. 5, Line 48, "to e received" should be --to be received--.

Signed and Sealed this

Third Day of August, 1993

*Attest:*

*Attesting Officer*

Michael K. Kirk

MICHAEL K. KIRK

*Acting Commissioner of Patents and Trademarks*